US008672444B2

(12) United States Patent
Sambhy et al.

(10) Patent No.: US 8,672,444 B2
(45) Date of Patent: Mar. 18, 2014

(54) METHODS FOR IN SITU APPLICATIONS OF LOW SURFACE ENERGY MATERIALS TO PRINTER COMPONENTS

(71) Applicant: Xerox Corporation, Norwalk, CT (US)

(72) Inventors: Varun Sambhy, Penfield, NY (US); Santokh S. Badesha, Pittsford, NY (US); Daniel J. McVeigh, Webster, NY (US); Peter M. Gulvin, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 0 days.

(21) Appl. No.: 13/745,206

(22) Filed: Jan. 18, 2013

(65) Prior Publication Data

US 2013/0286092 A1 Oct. 31, 2013

Related U.S. Application Data

(60) Provisional application No. 61/640,431, filed on Apr. 30, 2012.

(51) Int. Cl.
*B41J 2/165* (2006.01)

(52) U.S. Cl.
USPC ..... 347/28

(58) Field of Classification Search
USPC ..... 347/28
See application file for complete search history.

(56) References Cited

U.S. PATENT DOCUMENTS

| | | | | |
|---|---|---|---|---|
| 5,005,024 | A * | 4/1991 | Takahashi et al. | 347/45 |
| 5,389,958 | A * | 2/1995 | Bui et al. | 347/103 |
| 5,840,421 | A * | 11/1998 | Kobayashi et al. | 428/332 |
| 6,183,929 | B1 * | 2/2001 | Chow et al. | 430/124.37 |
| 6,409,304 | B1 * | 6/2002 | Taylor | 347/29 |
| 2007/0263028 | A1 * | 11/2007 | Zengo et al. | 347/33 |
| 2011/0122195 | A1 * | 5/2011 | Kovacs et al. | 347/45 |

* cited by examiner

*Primary Examiner* — Matthew Luu
*Assistant Examiner* — Alexander D Shenderov
(74) *Attorney, Agent, or Firm* — Pillsbury Winthrop Shaw Pittman LLP

(57) ABSTRACT

In an inkjet printer, a low surface energy material is applied to a printhead face and a drip bib during a printhead maintenance operation. The low surface energy material forms a thin layer on the printhead face and drip bib to resist adhesion of ink to the printhead. The low surface energy material can be a layer of silicone oil.

11 Claims, 4 Drawing Sheets

METHODS FOR IN SITU APPLICATIONS OF LOW SURFACE ENERGY MATERIALS TO PRINTER COMPONENTS

CROSS-REFERENCE TO RELATED APPLICATIONS

This application claims priority to U.S. Provisional Application Ser. No. 61/640,431, filed Apr. 30, 2012, which is expressly incorporated by reference.

Reference is also made to commonly owned and co-pending, U.S. patent application Ser. No. 13/745,054 entitled "Methods for In Situ Applications of Low Surface Energy Materials to Printer Components" to Michael L. Gumina, electronically filed on the same day herewith; and U.S. patent application Ser. No. 13/745,135 entitled "Methods for In Situ Applications of Low Surface Energy Materials to Printer Components" to Daniel J. McVeigh, electronically filed on the same day herewith which are expressly incorporated by reference.

TECHNICAL FIELD

This disclosure relates generally to inkjet printers that eject ink to form images on print media, and, more particularly, to components in inkjet printers that can accumulate ink build-up during printing operations.

BACKGROUND

In general, inkjet printers include at least one printhead that ejects drops of liquid ink onto an image receiving surface to produce ink images on recording media. A phase change inkjet printer employs phase change inks that are in the solid phase at ambient temperature, but transition to a liquid phase at an elevated temperature. A mounted printhead ejects drops of the melted ink to form an ink image on an image receiving surface. The image receiving surface can be the surface of print media or an image receiving member, such as a rotating drum or endless belt. Ink images formed on an image receiving member are later transferred to print media. Once the ejected ink is onto the media or image receiving member, the ink droplets quickly solidify to form an image.

The media on which ink images are produced can be supplied in sheet or web form. A media sheet printer typically includes a supply drawer that houses a stack of media sheets. A feeder removes a sheet of media from the supply and directs the sheet along a feed path past a printhead so the printhead ejects ink directly onto the sheet. In offset sheet printers, a media sheet travels along the feed path to a nip formed between the rotating imaging member onto which the ink image was formed and a transfix roller. The pressure and heat in the nip transfer the ink image from the imaging member to the media. In a web printer, a continuous supply of media, typically provided in a media roll, is entrained onto rollers that are driven by motors. The motors and rollers pull the web from the supply roll through the printer to a take-up roll. As the media web passes through a print zone opposite the printhead or heads of the printer, the printheads eject ink onto the web. Along the feed path, tension bars or other rollers remove slack from the web so the web remains taut without breaking.

An inkjet printer conducts various maintenance operations to ensure that the ink ejectors in each printhead operate efficiently. A cleaning operation is one such maintenance operation. The cleaning process removes particles or other contaminants that may interfere with printing operations from the printhead and may unclog solidified ink or contaminants from inkjet ejectors. During a cleaning operation, the printheads purge ink through some or all of the ink ejectors in the printhead. The purged ink flows through the ejectors and down the front face of the printheads, where the ink drips into an ink receptacle. To control the flow of ink down the face of each printhead, some printheads include a drip bib. The drip bib has a shape that directs liquid ink toward the ink receptacle. The lower edge of the drip bib tapers to one or more channels or points where ink collects prior to dripping into the receptacle. In some printers, a wiper engages the front face of the printhead and wipes excess purged ink in a downward direction toward the drip bib to remove excess purged ink.

FIG. 4 depicts a prior art printhead assembly 400. The printhead assembly 400 includes a housing 404, printhead face 408, inkjet nozzle plate 410, and a drip bib 412. The drip bib 412 includes an upper end 414 below the nozzle plate 410 and a lower edge that forms multiple tips 416A, 416B, 416C, and 416D. In alternative configurations, the drip bib 412 can include different configurations of the lower edge or liquid channels that direct purged ink toward a waste ink receptacle. During a maintenance operation, purged ink flows out of the inkjet nozzles in the inkjet nozzle plate 410 and flows down the printhead face 408 and drip bib 412 in direction 440 under the force of gravity. Most of the liquid ink concentrates near the tips 416A-416D of the drip bib and drips from the printhead assembly 400 into the waste ink receptacle. Some of the ink, however, can adhere to either the printhead face 408 or the drip bib 412 or both structures.

While the cleaning process removes most purged ink from the face of the printhead and the drip bib, small amounts of residual ink may accumulate on both the printhead face and the drip bib over time. These small amounts of ink can be produced by printing operations and by printhead maintenance operation. Ink that accumulates on the printhead face promotes "drooling" of ink through one or more inkjet nozzles due to capillary attraction between ink on the face of the printhead and ink within a pressure chamber in nearby inkjets. The drooled ink can form spurious marks on the image receiving surface and can interfere with the operation of inkjets in the printhead. Ink that adheres to the drip bib collects near a lower edge of the drip bib and can release from the drip bib after completion of the maintenance operation. In addition to forming spurious marks on the print medium, phase-change inks on drip bibs can cool and solidify prior to being released from the drip bib. The moving print media can carry the solidified ink past the printhead where the solidified ink can strike the printhead face with possibly adverse consequences to the printhead.

Existing printhead faces and drip bibs are often coated with a low surface energy material, such as polytetrafluoroethylene, which is sold commercially as Teflon®. The low surface energy material is also referred to as an "anti-wetting" material that resists the adhesion of liquid ink to the printhead or the drip bib. The low surface energy material is applied during the manufacture of the printhead face and drip bib. After prolonged use in a printer, however, the low surface energy coating can gradually wear away. For example, repeated contact with the print medium during operation can erode Teflon from the printhead face and the drip bib. Additionally, repeated contact with wiper blades and other printhead maintenance unit components can erode the low surface energy material. Over time, the printhead and drip bib may begin to accumulate larger amounts of excess ink, which can artificially shorten the operational lifetime of the printhead.

SUMMARY

In one embodiment, a method for performing printhead maintenance has been developed that reduces the adhesion of ink to a printhead. The method includes applying a low surface energy material to a face of a printhead during a printhead maintenance operation.

In another embodiment, a method for performing printhead maintenance has been developed that reduces the adhesion of ink to a drip bib. The method includes applying a low surface energy material to a surface of a drip bib located below a face of a printhead during a printhead maintenance operation.

DETAILED DESCRIPTION

Figure 1:
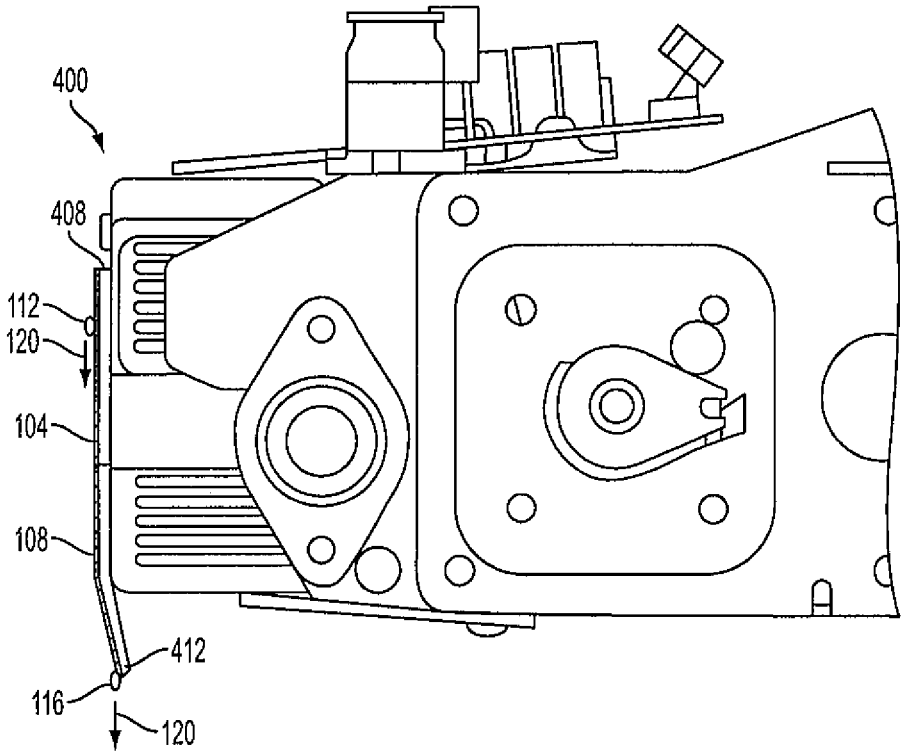
FIG. 1 is a profile view of a printhead and drip bib with an application of a low surface energy material to the surface of the printhead face and drip bib.

For a general understanding of the environment for the system and method disclosed herein as well as the details for the system and method, reference is made to the drawings. In the drawings, like reference numerals have been used throughout to designate like elements. As used herein the term "printer" refers to any device that is configured to eject a marking agent upon an image receiving surface and include photocopiers, facsimile machines, multifunction devices, as well as direct and indirect inkjet printers. An image receiving surface refers to any surface that receives ink drops, such as an imaging drum, imaging belt, or various print media including paper.

As used herein, the term "low surface energy material" refers to a material that tends to prevent a liquid from wetting, and consequently adhering to, a surface. For example, liquid ink can adhere to the surface of printheads or drip bibs. A coating of a low surface energy material, however, resists the adhesion of the ink to the surface. Instead, the liquid ink contracts into one or more droplets due to the inherent surface tension of the ink and the drops slide down the surface of the printhead or drip bib under the force of gravity. Eventually the ink flows to a lower edge of the printhead, such as to a lower edge of the drip bib, and the liquid ink detaches from the printhead for collection in a waste ink receptacle.

One example of a low surface energy material is silicone oil, which is also referred to as a silicone fluid. The oil has chemical and physical properties that will allow it to form a uniform and tightly bound thin film on the nozzle plate and will impart surface properties such as high ink contact angle and low ink sliding angle. In other embodiments, the layer will have a high ink contact angle of from about 30 to about 90, or from about 45 to 90, or from about 45 to about 70. In further embodiments, the layer will have a low ink sliding angle of from about 1 to about 40, or from about 1 to about 35, or from about 15 to about 35. In embodiments, the layer will have a thickness of from about 0.1 micron to about 100 microns, or from about 0.1 micron to about 1 micron, or from about 1 micron to about 100 microns. Several different classes of functional oils may be used, including but not limited to, silicone oils with amine functional groups, fluorinated silicone oils, and low molecular weight perfluoropolyether oils such as those commercially available under the tradename Fluorolink® from Solvay Solexis. Suitable perfluoropolyether oils have low molecular weights of from about 500 amu to about 10,0000 amu, or from about 1000 amu to about 10000 amu, or from about 10000 amu to about 100000 amu.

Various forms of silicone oil are sold commercially and can include different additives. In particular, amino modified silicone oils include alkyl amino additives. Alkyl amino additives promote bonding between the silicone oil and metal surfaces such as metal surfaces of the printhead face and drip bib. One example of a silicone oil is Xerox product part number 008R13115, labeled as "Spreader Agent," and sold by the Xerox Corporation of Norwalk, Conn. A reference to silicone oil in this document includes silicone oils with or without additives.

Other specific oils can include, but are not limited to, those listed in Table 1 below.

TABLE 1

| Tradename | Type | Chemical Name | Structure | Viscosity (cS) | Molar Percent of functional group (%) |
|---|---|---|---|---|---|
| Fuser Agent F1076 | mercapto | Pendant propylmercapto | 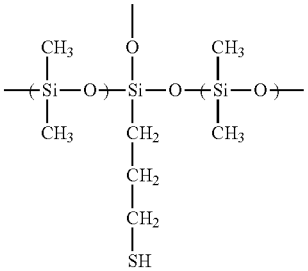 | 265 (225-300) | % Thiol-SH 0.21 (0.18-0.23) |

TABLE 1-continued

| Tradename | Type | Chemical Name | Structure | Viscosity (cS) | Molar Percent of functional group (%) |
|---|---|---|---|---|---|
| Fuser Shield AKF275 | amino | Pendant propylamine | 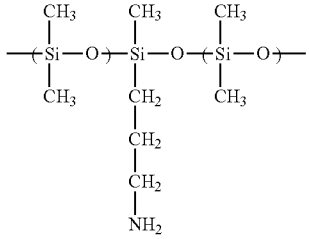 | 300 (270-330) | % Amine-$NH_2$ 0.67 (0.06-0.09) |
| Fuser Agent II | | | | 350 | % Amine-$NH_2$ 0.08 |
| | | | | 350 | % Amine-$NH_2$ 0.08 |
| | | | | 100 | % Amine-$NH_2$ 0.20 |
| Fuser Fluid | | | | 575 | % Amine-$NH_2$ 0.09 |
| Fuser Fluid II | | | | 575 | % Amine-$NH_2$ 0.24 |
| Fuser Blend AKF260 | amino-mercapto blend | Pendant propylmercapto & pendant propylamino | Both of the above | 269 (240-340) | % amino 0.011 (0.007-0.015) % mercapto 0.19 (0.13-0.27) |
| Copy Aid 200 (concentrate) | diamino | Pendant N-(2-aminoethyl)-3-aminopropyl | 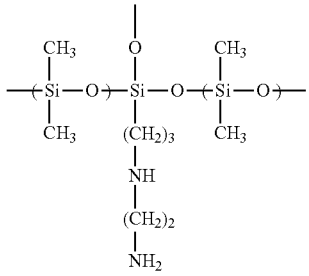 | 410-860 | % amine-$NH_2$ 0.37-0.63 (i.e., 0.74-1.26 amine) |
| SLM-50330 lot AKF-290 | fluoro | Pendant tridecafluoro-octyl | 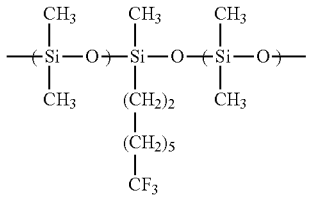 | 210 | % tridecafluorooctyl 5.70 |
| SLM-443401 ER-47042 ER-47043 EF-27110 | a-w amino | Terminal propylamine | 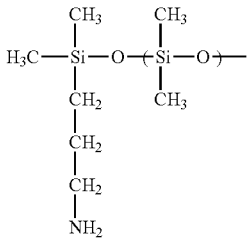 | 316 251 229 | % amine 0.058 0.107 0.065 0.074 |
| Fluorolink-D Fluorolink-E10H Fluorolink-A Fluorolink-S | | Perfluoropoly-ether | $HOCH_2CF_2O(CF_2CF_2O)_p(CF_2O)_qCF_2CH_2OH$ | | % hydroxyl-OH % carboxyl-COOH % siloxane 70-100 |

Silicone oils are described as non-limiting examples of low surface energy materials, but those having skill in the art recognize that other appropriate materials with low surface energy properties can be used with the processes described below.

In embodiments, the oil layer applied comprises of 100% oil component. In some embodiments, the oil may be further mixed with a volatile solvent or a mixture of volatile solvents and applied as a solution. In such embodiments, the solvent evaporates and leaves behind a thin uniform layer of oil. Examples of solvents include (but not limited to) hydrocarbon solvents such as hexanes, toluene, methyl ethyl ketone & acetone, alkyl acetates such as ethyl acetate and butyl acetate, alcohols such as ethyl alcohol & isopropyl alcohol, and halogenated solvents such as chloroform, methylene chloride, trifluoroluene, Novec 7200 and Novec 7300 (commercially available from 3M Company (St. Paul, Minn.)), Asahikilin 225 (commercially available from Asahi Glass Co., Ltd. (Tokyo, Japan)) and the like, and mixtures thereof. In embodiments, the concentration of oil in the solvent solution is of from about 0.1% to about 100%, or from about 1% to about 10%, or from about 10% to about 100%

Figure 4:
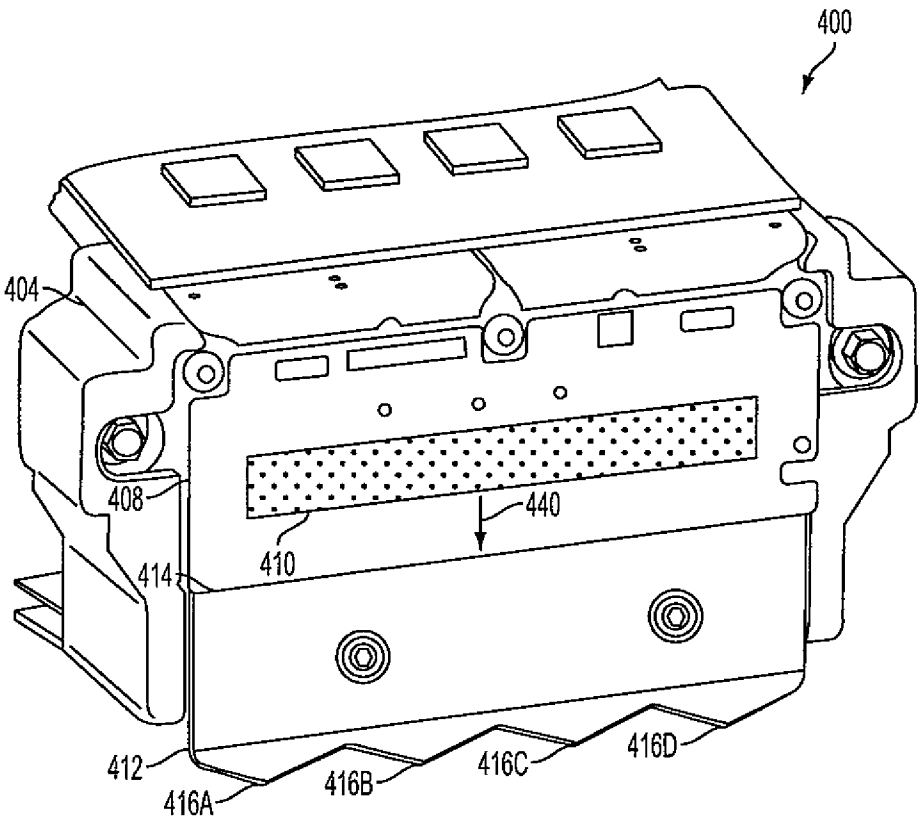
FIG. 4 PRIOR ART
FIG. 4 is a front view of a prior art printhead and drip bib

FIG. 1 depicts the printhead unit 400 of FIG. 4 in profile view. In FIG. 1, a thin layer of low surface energy material covers the surface of the printhead face 408 and the drip bib 412. Low surface energy material 104 covers the printhead face 408. In one example, a thin layer of silicone oil covers the surface of the printhead 412 while leaving the nozzles in the inkjet nozzle plate 410 unblocked. Thus, the silicone oil does not interfere with the operation of the inkjets in the printhead. The low surface energy material 112 covers the surface of the drip bib 412 to resist the adhesion of ink to the drip bib 412. In a typical embodiment, the low surface energy material covers the printhead face 108 and drip bib 412 with a thickness of less than 10 microns. The low surface energy materials 104 and 108 are numbered separately for illustrative purposes, but a silicone oil or other low surface energy material coating can form a substantially uniform coating that covers both the printhead face 408 and the surface of the drip bib 412. In embodiments, the printhead may be comprised of the material selected from the group consisting of steel, polyimide, silicon wafer, aluminum, gold, and the like, and mixtures thereof.

FIG. 1 depicts excess ink drops 112 and 116 on the printhead assembly 400. The ink drop 112 contacts the low surface energy material 104 on the printhead face 112. Gravity pulls the ink drop 112 downward in direction 120. Another ink drop 116 on the drip bib 412 contacts the low surface energy material 108. The force of gravity pulls the ink drop 116 from the lower edge of the drip 412. During a maintenance operation, the ink drop 116 falls into a waste ink receptacle for disposal or recycling in the printer.

Figure 2:
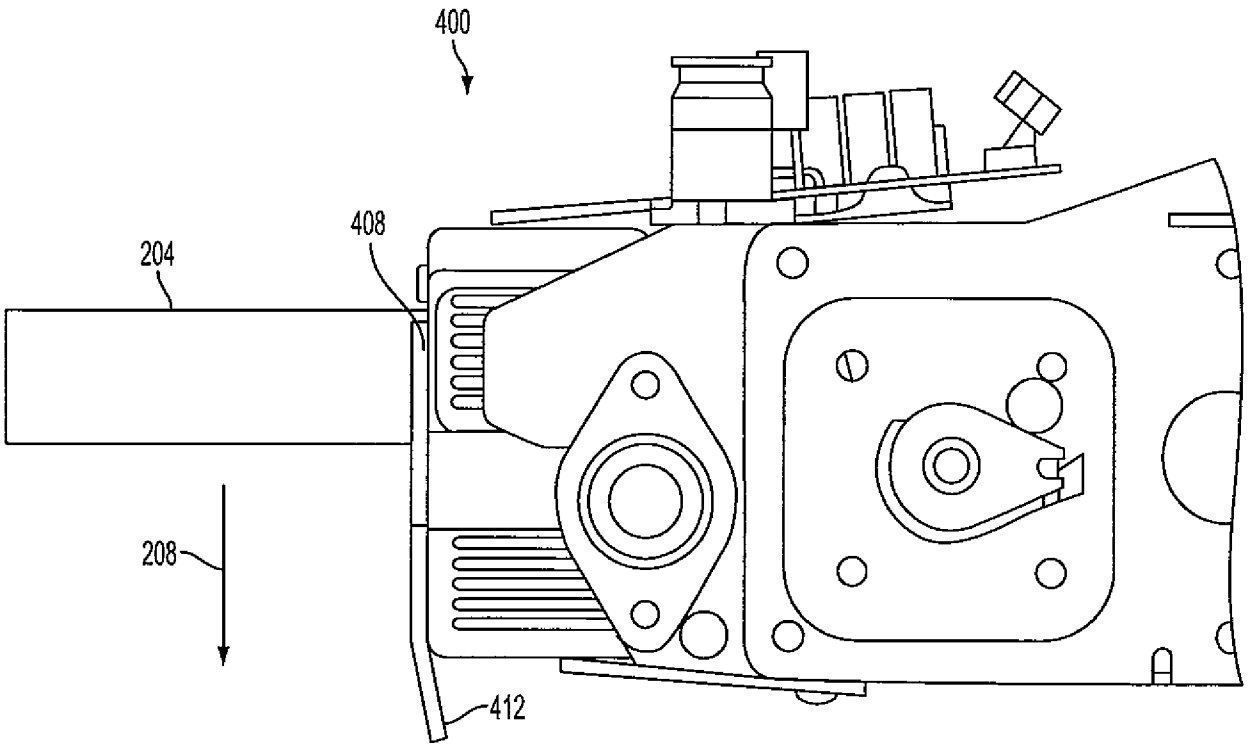
FIG. 2 is a profile view of a foam pad that applying a coating of low surface energy material to the printhead and drip bib of FIG. 1.

The low surface energy material can be applied to the printhead face 408 and drip bib 412 manually or automatically during a printhead maintenance process. FIG. 2 depicts an exemplary embodiment for application of silicone oil to the printhead assembly 400. In FIG. 2 a foam pad 204, or another porous material, holds a quantity of silicone oil or another liquid with low surface energy. The foam pad 204 is pressed against the printhead face 408 and moves downward in direction 208 across the printhead face 408 and the drip bib 412. The foam pad transfers a small amount of the silicone oil to the printhead face 408 and the surface of the drip bib 412. The foam pad also spreads the silicone oil to form a thin and uniform layer of the silicone oil. The foam pad 204 with the silicone oil can be included as part of an automated printhead maintenance unit that engages the printhead assembly 400 during a maintenance process. In a manual operation, an operator applies the silicone oil to a cloth and wipes the printhead face 408 and drip bib 412 with the cloth to apply the silicone oil. The operator removes excess silicone oil with a dry cloth.

Figure 3:
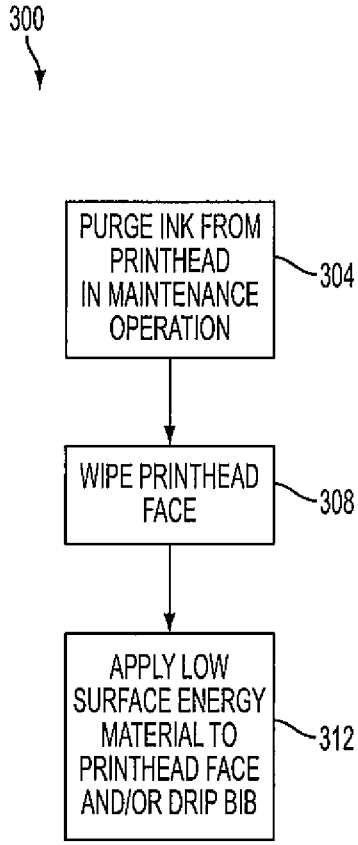
FIG. 3 is block diagram of a process for applying low surface energy material to the surface of a printhead and drip bib during a printhead maintenance process.

FIG. 3 depicts a block diagram of a process 300 for applying the low surface energy material to a printhead. Process 300 can be carried out in an automated manner during a printhead maintenance process in an inkjet printer. In the discussion below, a reference to the process performing a function or action refers to a controller executing programmed instructions stored in a memory to operate one or more components to perform the function or action. Process 300 is described in conjunction with the printhead unit 400 and foam pad 204 for illustrative purposes.

Process 300 begins when ink is purged through the inkjet nozzles in the inkjet nozzle plate 410 (block 304). In one embodiment, pressurized air is applied to an ink reservoir that supplies ink to the inkjet nozzles to urge ink through the inkjets and out of the nozzles. The energy of this released ink is less than that of ejected ink drops so the purged ink subsequently flows down the surface of the printhead face 408 and the drip bib 412. Most of the purged ink drips from the drip bib 412 and enters an ink collection receptacle (not shown) that is positioned below the printhead assembly 400.

After the printhead purges ink, the printhead maintenance unit can optionally wipe the printhead face 408 (block 308). In one embodiment, a wiper blade engages the printhead face 408 above the inkjet nozzle plate 410, and wipes downwardly in the same direction 208 depicted in FIG. 2 for the application of the silicone oil. The wiper removes residual ink from the printhead face shortly after the printhead finishes purging ink.

After completion of the wiping process, the printhead face 408 and drip bib 412 are substantially clear of ink. Process 300 next operates one or more applicators to apply low surface energy material to either or both of the printhead face 408 and drip bib 412 (block 312). As depicted in FIG. 2, the foam block 204 that carries silicone oil can apply a thin layer of the silicone oil to the printhead face 408, including the inkjet nozzle plate 410. The foam block 204 can also apply the silicone oil to the drip bib 412. Alternatively, an atomizer may be used to apply a fine mist of low energy material to the printhead face 408, the drip bib 412, or both.

Table 2 below lists the drool pressure performance of a new Maverick printhead with cyan solid ink without any application of oil. Drool pressure relates to the ability of the aperture plate to avoid ink weeping out of the nozzle opening when the pressure of the ink tank or the reservoir increases. Maintaining a higher pressure without weeping allows for faster printing when a print command is given. Also the drool pressure needs to be maintained typically above 0.5 inches of water for proper printhead operation and maintenance. A new maverick printhead labeled 7-1 was mounted in an internal Xerox CiPress type solid ink print engine and was subjected to print run. As can be clearly seen, the drool pressure of a new printhead falls from 1.5 inches of water to about 0.6 inches of water within 40 days of printing.

TABLE 2

| | Drool Pressure (Inches of water) Drool Pressure without oil | | |
|---|---|---|---|
| Printhead name | Day 1 | Day 13 | Day 40 |
| 7-1 Control New Printhead | 1.5 | 1.2 | 0.6 |

Table 3 below lists the drool pressure performance of Maverick printhead with cyan solid ink with application of oil. Maverick Printheads labeled 5-3, 6-1 and 6-3 mounted in an internal Xerox CiPress solid ink print engine were treated with a thin layer of silicone oil by gently rubbing the printhead faceplate with a cloth wipe soaked in silicone oil. As can be seen clearly, these printheads had very low drool pressure of <0.5 inches before application of oil. Typically at drool pressure below 0.5 inches of water, the printhead fails due to spontaneous weeping of ink from the nozzles. After application of silicone oil, the drool pressures increased dramatically and stayed >2 inches for more than 40 days of printing.

TABLE 3

| Printhead Name | Initial Drool Pressure Before Oiling (Inches of water) | Drool Pressure after After Oiling (Inches of water) | | |
|---|---|---|---|---|
| | | Day 1 | Day 13 | Day 40 |
| 5-3 | 0.3 | >2 | >2 | >2 |
| 6-1 | 0.2 | >2 | >2 | >2 |
| 6-3 | 0.1 | >2 | >2 | >2 |

In one embodiment, the application of low surface energy material in process 300 does not occur during every printhead maintenance cycle. For example, in an exemplary embodiment, a single application of silicone oil to the printhead face 408 has been effective for a time span of several weeks during operation of the printer. Over time the silicone oil or other low surface energy material may be worn away. The silicone oil or other low surface energy material can be applied again during a subsequent printhead maintenance operation without the need to remove the printhead from the printer. While existing printheads and drip bibs are manufactured with a low surface energy coating that can erode during operation, the low surface energy materials and methods described herein enable the printhead and drip bib to maintain a surface layer with a low surface energy during prolonged operation of the printer. The silicone oil or other low surface energy material enables the printhead and drip bib to remain substantially free of ink during operation to reduce or eliminate inkjet drooling and unwanted transfer of ink in the printer. Additionally, the silicone oil layer is applied in situ within the printer can eliminate the need to form Teflon coatings on the printhead and drip bib during the manufacturing process. The in situ application avoids issues with degradation of surface properties of the low surface energy material from the harsh fabrication conditions that occur during the stacking/bonding step since the layer is applied after the bonding step. In addition, a low surface energy materials used can suffer from cracking or incomplete ablation when the apertures are drilled into the nozzle plate to form nozzles. Applying the low surface energy material as a layer where the material is mobile (e.g., oil layer) instead of applying the material as a coating formed onto the printhead and drip bib allows the material to flow and cover potential defects such as laser debris, particles, scratches, and the like, around the nozzles on the nozzle plates.

It will be appreciated that variants of the above-disclosed and other features and functions, or alternatives thereof, may be desirably combined into many other different systems, applications or methods. Various presently unforeseen or unanticipated alternatives, modifications, variations or improvements therein may be subsequently made by those skilled in the art which are also intended to be encompassed by the following claims.

We claim:

1. A method for performing maintenance on a printhead unit in a printer comprising:

applying a low surface energy material to a face of a printhead during a printhead maintenance operation when ink is purged from inkjet nozzles; and purging ink from inkjet nozzles, wherein the low surface energy material is selected from the group consisting of a silicone oil, a liquid fluoropolymer, and mixtures thereof.

2. The method of claim 1, wherein the silicone oil is selected from the group consisting of silicone oils with amine functional groups, fluorinated silicone oils, and mixtures thereof.

3. The method of claim 2, wherein the silicone oil includes an alkyl amino additive.

4. The method of claim 2, wherein the silicone oil is further selected from an oil comprising the structures from the group consisting of a pendant propylmercapto, a pendant propylamine, a pendant N-(2-aminoethyl)-3-aminopropyl, a pendant tridecafluoro-octyl, a terminal propylamine, and mixtures thereof.

5. The method of claim 1 further comprising:

wiping the face of the printhead to remove ink from the face of the printhead prior to application of the low surface energy material during the printhead maintenance operation.

6. The method of claim 1 further comprising:

applying the low surface energy material to a drip bib associated with the printhead face.

7. The method of claim 1, the application of the low surface energy material further comprising:

applying the low surface energy material to a foam pad; and moving the foam pad across the face of the printhead.

8. The method of claim 1 being automated.

9. The method of claim 1, wherein the printhead comprises a material selected from the group consisting of steel, polyimide, silicon, aluminum, gold, and mixtures thereof.

10. The method of claim 1, wherein the face of the printhead treated with the low surface energy material has an ink contact angle of from 30 degrees to 90 degrees.

11. The method of claim 1, wherein the face of the printhead treated with the low surface energy material has an ink sliding angle of from 1 degree to 40 degrees.

* * * * *